US010793801B2

(12) United States Patent
Patil et al.

(10) Patent No.: US 10,793,801 B2
(45) **Date of Patent: *Oct. 6, 2020**

(54) LOW TRANSITION TEMPERATURE MIXTURES AND LUBRICATING OILS CONTAINING THE SAME

(71) Applicant: ExxonMobil Chemical Patents Inc., Baytown, TX (US)

(72) Inventors: Abhimanyu O. Patil, Westfield, NJ (US); Satish Bodige, Wayne, NJ (US); Thilina N. Gunasekara, New York, NY (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/879,911

(22) Filed: Jan. 25, 2018

(65) Prior Publication Data

US 2018/0223210 A1 Aug. 9, 2018

Related U.S. Application Data

(60) Provisional application No. 62/455,160, filed on Feb. 6, 2017.

(51) Int. Cl.
*C10M 105/14* (2006.01)
*C10M 105/16* (2006.01)
(Continued)

(52) U.S. Cl.
CPC ..... *C10M 105/14* (2013.01); *C10M 105/16* (2013.01); *C10M 105/58* (2013.01);
(Continued)

(58) Field of Classification Search
CPC ..... C10M 2207/022; C10M 2207/024; C10M 2215/04; C10M 2207/0225;
(Continued)

(56) References Cited

U.S. PATENT DOCUMENTS 1,815,022 A 7/1931 Davis
2,100,993 A 11/1937 Bruson
(Continued)

FOREIGN PATENT DOCUMENTS

CA 1094044 1/1981
CN 106474873 A 3/2017
(Continued)

OTHER PUBLICATIONS

Habibi, Emadaldin et al., "A novel digestion method based on a choline chloride-oxalic acid deep eutectic solvent for determining Cu, Fe, and Zn in fish samples," Analytica Chimica Acta, 2013, vol. 762, pp. 61-67.

(Continued)

*Primary Examiner* — Vishal V Vasisth

(57) ABSTRACT

Low transition temperature mixtures (LTTMs) comprising a eutectic mixture of a quaternary amine and a polyol such as glycol are provided. The LTTMs can provide various beneficial properties, such as highly desirable viscosity index, low glass transition temperatures, and/or high kinematic viscosities relative to the molecular weight of the mixture components. The mixtures can be advantageously used as co-base stocks in lubricating oil compositions.

18 Claims, 12 Drawing Sheets

(51) Int. Cl.

| | |
|---|---|
| ***C10M 105/58*** | (2006.01) |
| ***C10M 171/04*** | (2006.01) |
| ***C10M 171/02*** | (2006.01) |
| ***C10M 111/02*** | (2006.01) |
| *C10N 30/02* | (2006.01) |
| *C10N 30/06* | (2006.01) |

(52) U.S. Cl.
CPC ..... *C10M 111/02* (2013.01); *C10M 171/02* (2013.01); *C10M 171/04* (2013.01); *C10M 2207/022* (2013.01); *C10M 2207/024* (2013.01); *C10M 2207/0225* (2013.01); *C10M 2215/04* (2013.01); *C10M 2215/0425* (2013.01); *C10N 2030/02* (2013.01); *C10N 2030/06* (2013.01)

(58) Field of Classification Search
CPC ..... C10M 2215/0425; C10N 2230/02; C10N 2230/06; C10N 2020/02; C10N 2030/02; C10N 2030/06; C10N 2040/25
See application file for complete search history.

(56) References Cited

U.S. PATENT DOCUMENTS

| | | | |
|---|---|---|---|
| 2,191,498 | A | 2/1940 | Reeiff |
| 2,387,501 | A | 10/1945 | Dietrich |
| 2,666,476 | A | 1/1954 | Munday et al. |
| 2,721,877 | A | 10/1955 | Popkin et al. |
| 2,721,878 | A | 10/1955 | Popkin |
| 2,817,693 | A | 12/1957 | Knome et al. |
| 3,036,003 | A | 6/1962 | Verdol |
| 3,087,936 | A | 4/1963 | La Suer |
| 3,172,892 | A | 3/1965 | La Suer et al. |
| 3,200,107 | A | 8/1965 | Le Suer |
| 3,215,707 | A | 11/1965 | Rense |
| 3,219,666 | A | 11/1965 | Norman et al. |
| 3,250,715 | A | 5/1966 | Wyman |
| 3,254,025 | A | 5/1966 | La Suer |
| 3,272,746 | A | 9/1966 | La Suer et al. |
| 3,275,554 | A | 9/1966 | Wagenaar |
| 3,316,177 | A | 4/1967 | Dorer, Jr. |
| 3,322,670 | A | 5/1967 | Burt et al. |
| 3,329,658 | A | 7/1967 | Fields |
| 3,341,542 | A | 9/1967 | La Suer et al. |
| 3,313,347 | A | 11/1967 | Worrel |
| 3,382,291 | A | 5/1968 | Brennan |
| 3,438,757 | A | 4/1969 | Honnen et al. |
| 3,444,170 | A | 5/1969 | Norman et al. |
| 3,449,250 | A | 6/1969 | Fields |
| 3,454,555 | A | 7/1969 | Van der Voort et al. |
| 3,454,607 | A | 7/1969 | La Suer et al. |
| 3,519,565 | A | 7/1970 | Coleman |
| 3,541,012 | A | 11/1970 | Stuebe |
| 3,565,804 | A | 2/1971 | Honnen et al. |
| 3,595,791 | A | 7/1971 | Cohen |
| 3,630,904 | A | 12/1971 | Musser et al. |
| 3,632,511 | A | 1/1972 | Liao |
| 3,652,616 | A | 3/1972 | Watson et al. |
| 3,666,730 | A | 5/1972 | Coleman |
| 3,687,849 | A | 8/1972 | Abbott |
| 3,697,574 | A | 10/1972 | Pisek et al. |
| 3,702,300 | A | 11/1972 | Coleman |
| 3,703,536 | A | 11/1972 | Piasek et al. |
| 3,704,308 | A | 11/1972 | Piasek et al. |
| 3,725,277 | A | 4/1973 | Worrel |
| 3,725,480 | A | 4/1973 | Traise et al. |
| 3,726,882 | A | 4/1973 | Traise et al. |
| 3,742,082 | A | 6/1973 | Brennan |
| 3,751,365 | A | 8/1973 | Piasek et al. |
| 3,755,433 | A | 8/1973 | Miller et al. |
| 3,756,953 | A | 9/1973 | Piasek et al. |
| 3,769,363 | A | 10/1973 | Brennan |
| 3,787,374 | A | 1/1974 | Adams |
| 3,798,165 | A | 3/1974 | Piasek et al. |
| 3,803,039 | A | 4/1974 | Piasek et al. |
| 3,822,209 | A | 7/1974 | Knapp et al. |
| 3,876,720 | A | 4/1975 | Heilman et al. |
| 3,948,800 | A | 4/1976 | Meinhardt et al. |
| 4,100,082 | A | 7/1978 | Clason et al. |
| 4,149,178 | A | 4/1979 | Estes |
| 4,218,330 | A | 8/1980 | Shubkin |
| 4,234,435 | A | 11/1980 | Meinhardt et al. |
| 4,239,930 | A | 12/1980 | Allphin et al. |
| 4,367,352 | A | 1/1983 | Watts et al. |
| 4,413,156 | A | 11/1983 | Watts, Jr. et al. |
| 4,426,305 | A | 1/1984 | Malec |
| 4,434,408 | A | 2/1984 | Baba et al. |
| 4,454,059 | A | 6/1984 | Pindar et al. |
| 4,594,172 | A | 6/1986 | Sie |
| 4,727,064 | A | 2/1988 | Pitha |
| 4,767,551 | A | 8/1988 | Hunt et al. |
| 4,797,178 | A | 1/1989 | Bui et al. |
| 4,798,684 | A | 1/1989 | Salomon |
| 4,827,073 | A | 5/1989 | Wu |
| 4,910,355 | A | 3/1990 | Shubkin et al. |
| 4,921,594 | A | 5/1990 | Miller |
| 4,943,672 | A | 7/1990 | Hammer et al. |
| 4,952,739 | A | 8/1990 | Chen |
| 4,956,122 | A | 9/1990 | Watts et al. |
| 4,975,177 | A | 12/1990 | Garwood et al. |
| 5,068,487 | A | 11/1991 | Theriot |
| 5,075,269 | A | 12/1991 | Degnan et al. |
| 5,084,197 | A | 1/1992 | Galic et al. |
| 5,430,105 | A | 7/1995 | Redpath et al. |
| 5,705,458 | A | 1/1998 | Roby et al. |
| 6,034,039 | A | 3/2000 | Gomes et al. |
| 6,080,301 | A | 6/2000 | Berlowitz et al. |
| 6,090,989 | A | 7/2000 | Trewella et al. |
| 6,130,190 | A | 10/2000 | Gunsel et al. |
| 6,165,949 | A | 12/2000 | Berlowitz et al. |
| 6,323,164 | B1 | 11/2001 | Liesen et al. |
| 7,018,960 | B2 | 3/2006 | Negoro et al. |
| 7,485,604 | B2 | 2/2009 | Negoro et al. |
| 7,704,930 | B2 | 4/2010 | Deckman et al. |
| 7,735,461 | B2 | 6/2010 | Vetrovec |
| 8,048,833 | B2 | 11/2011 | Habeeb et al. |
| 2008/0020950 | A1 | 1/2008 | Gray et al. |
| 2012/0028855 | A1 | 2/2012 | Miller |
| 2014/0259887 | A1 | 9/2014 | Kornfield et al. |
| 2015/0094459 | A1 | 4/2015 | Kroon et al. |
| 2016/0122676 | A1 | 5/2016 | Patil et al. |
| 2017/0157717 | A1 | 6/2017 | Ryder et al. |

FOREIGN PATENT DOCUMENTS

| | | |
|---|---|---|
| EP | 0471071 | 2/1991 |
| EP | 0464547 | 6/1991 |
| EP | 0464546 | 1/1992 |
| EP | 2597099 | 11/2011 |
| GB | 1350257 | 4/1974 |
| GB | 1390359 | 4/1975 |
| GB | 1429494 | 3/1976 |
| GB | 1440230 | 6/1976 |
| WO | 1999/24533 A1 | 5/1999 |
| WO | 2013/153203 | 10/2013 |
| WO | 2015/159070 A | 10/2015 |
| WO | 2016/073149 | 5/2016 |

OTHER PUBLICATIONS

Francisco et al., "A new low transition temperature mixture (LTTM) formed by choline chloride + lactic acid Characterization as solvent for CO2 capture", Fluid Phase Equilibria, 2013, vol. 340, pp. 77-84.
Shi et al., "Friction and Wear Behavior of CF/PTFE Composites Lubricated by Choline Chloride Ionic Liquids", Triobology Letters, 2013, vol. 49, No. 2, pp. 413-420.
Russ et al., "Low melting mixtures in organic synthesis—an alternative to ionic liquids?", Green Chemistry, 2012, vol. 14, No. 11, pp. 2969-2982.

(56) References Cited

OTHER PUBLICATIONS

Kareem et al., "Phosphonium-Based Ionic Liquids Analogues and Their Physical Properties", Journal of Chemical & Engineering Data, 2010, vol. 55, No. 11, pp. 4632-4637.
Zhang et al., "Properties and Applications of Choline-Based Deep Eutectic Solvents", Progress in Chemistry, vol. 25, No. 6, pp. 881-892.
Tang et al., "Recent developments in deep eutectic solvents in chemical sciences", Monatshefte fuer Chemie, 2013, vol. 44, No. 10, pp. 1427-1454.
Abbott et al., "Design of Improved Deep Eutectic Solvents Using Hole Theory", ChemPhysChem, 2006, vol. 7, No. 4, pp. 803-806.
Durand et al., "Deep eutectic solvents: Synthesis, application, and focus on lipase-catalyzed reactions", European Journal of Lipid Science and Technology, 2013, vol. 115, No. 4, pp. 379-385.
Zhang et al., "Properties and applications of choline chloride/urea and choline chloride/glycerol", Scientia Sinica Chimica, 2014, vol. 44, No. 6, pp. 927-941.
Abbott, A.P. et al. "Evaluating water miscible deep eutectic solvents (DESs) and ionic liquids as potential lubricants", Green Chemistry, vol. 16, No. 9, pp. 4156-4161, 2014.
Mjalli, F.S. et al. "Ethaline and Glyceline binary eutectic mixtures: characteristics and intermolecular interactions", Asi-Pacific Journal of Chemical Engineering, vol. 12, No. 2, pp. 313-320, 2017.
Francisco, M. et al. "Low-Transition-Temperature Mixtures (LTTMs): A New Generation of Designer Solvents", Chem. Int. Ed., vol. 52, pp. 3074-3085, 2013.
Francisco, M. et al. "New natural and renewable low transition temperature mixtures (LTTMs): screening as solvents for lignocellulosic biomass processing", Green Chemistry. vol. 14, pp. 2153-2157, 2012.
Abbott, A.P. et al. "Deep Eutectic Solvents Formed between Choline Chloride and Carboxylic Acids: Versatile Alternatives to Ionic Liquids", J. Am. Chem. Soc., vol. 126, pp. 9142-9147. 2004.
Abbott, A.P. et al. "Novel solvent properties of choline chloride/urea mixtures", Chem. Comm., pp. 70-71. 2003.

LOW TRANSITION TEMPERATURE MIXTURES AND LUBRICATING OILS CONTAINING THE SAME

PRIORITY CLAIM

This application claims the benefit of Provisional Application No. 62/455,160, filed Feb. 6, 2017, the disclosure of which is incorporated herein by reference.

FIELD OF THE INVENTION

The present invention relates to organic low-transition-temperature eutectic mixtures (LTTMs) and lubricant oils containing the same. In particular, the present invention relates to LTTMs comprising a eutectic mixture of a quaternary amine and a polyol and lubricant base oils and lubricant formulations containing the same.

BACKGROUND OF THE INVENTION

A major challenge in engine oil formulation is simultaneously achieving wear control, and friction reduction, while also maintaining fuel economy performance, over a broad temperature range.

Lubricant-related wear control is highly desirable due to increasing use of low viscosity engine oils for improved fuel efficiency. As governmental regulations for vehicle fuel consumption and carbon emissions become more stringent, use of low viscosity engine oils to meet the regulatory standards is becoming more prevalent. At the same time, lubricants need to provide a substantial level of wear protection and friction reduction due to the formation of thinner lubricant films during engine operation. As such, use of antiwear additives and friction modifiers in a lubricant formulation is the typical method for achieving wear control and friction reduction. Due to limitations of using high levels of antiwear and friction modifier additives such as catalyst poisoning and deposit formation, it is highly desirable to find alternative methods for achieving excellent wear control and friction reduction without poisoning the catalyst.

Developing more effective additive package in combination with balancing lubricant viscosity has proven to be a successful and cost-effective route to improving engine efficiency and durability. Commercial lubricants are composed of base stock and several categories of additives including anti-wear, friction modifier, viscosity modifier, antioxidant, detergent, dispersant, etc. Specifically, friction modifiers and anti-wear agents play key role in reducing boundary and mixed friction and wear in engine locations such as the top-ring-reversal region of the piston ring-cylinder liner interface and sliding surfaces in the valve train. Furthermore, an effective anti-wear additive allows using a low viscosity lubricant, consequently reducing elasto-hydrodynamic friction loss.

Polyalpha-olefins ("PAOs") are important lube base stocks with many excellent lubricant properties, including high viscosity index (VI), low volatility and are available in various viscosity ranges (KV100 of 2-300 cSt). However, PAOs are typically paraffinic hydrocarbons with low polarity. This low polarity leads to low solubility and dispersancy for polar additives or sludge generated during service. To compensate for this low polarity, lube formulators usually add one or multiple polar co-base stocks. Ester or alkylated naphthalene (AN) is usually present at 1 to 50 wt % levels in many finished lubricant formulations to increase the fluid polarity which improves the solubility of polar additives and sludge.

There is a need for base stocks or multifunctional fluids with better properties and the lube products with differentiation features. Ionic liquids have been an active area of research at various universities, government labs and companies. Ionic liquids are effective lube additives but can have disadvantages such as toxicity, high cost, limited range of available raw materials, and difficulties in achieving a high purity.

Despite advances in lubricant oil formulation technology, there exists a need for an engine oil lubricant that effectively improves wear control while maintaining or improving fuel efficiency. In addition, there exists a need for an engine oil lubricant that effectively improves wear control and friction reduction while maintaining or improving fuel efficiency.

U.S. Patent Publication No. 2016/0122676 A1 describes low transition temperature mixtures or deep eutectic solvents and processes for preparation thereof. Various low transition temperature mixtures are described, including mixtures of choline chloride with malic acid or lactic acid.

SUMMARY OF THE INVENTION

It has been found that low-transition-temperature liquid containing a eutectic mixture of a quaternary amine and a polyol can be advantageously used as a lubricating oil base stock given its low glass transition temperature, high viscosity index, low traction coefficient, and kinematic viscosity at the normal use temperatures of lubricants.

In one aspect, a composition comprising a eutectic mixture is provided. The mixture can include a first component comprising a quaternary amine having at most 6 carbon atoms per molecule. The mixture can further include a second component comprising a polyol having at least two alcoholic hydroxyl functional groups per molecule. A molar ratio of the first component to the second component in the mixture can be in a range from 1:1 to 1:9. The composition can further exhibit a glass transition temperature of no higher than −70° C., a viscosity index of at least 60, and a kinematic viscosity at 100° C. in a range from 2.0 to 40 cSt. The eutectic mixture can exhibit a low transition temperature.

In another aspect, a composition comprising a eutectic mixture based on a quaternary amine as a first component and a glycol as a second component is provided. The quaternary amine has at most 6 carbon atoms per molecule. The glycol is preferably ethylene glycol. A molar ratio of the first component to the second component in the mixture can range from 1:2 to 1:6. The composition can exhibit a glass transition temperature of no higher than −110° C., a viscosity index of at least 90, and a kinematic viscosity at 100° C. in a range from 2.0 to 6.0 cSt.

In still another aspect, a lubricating oil is provided. The lubricating oil can include a primary lubricating oil base stock and a secondary lubricant component. The secondary lubricant component has a composition capable of forming a eutectic mixture if not added into the lubricating oil. The eutectic mixture can include a first component comprising a quaternary amine comprising at most 6 carbon atoms per molecule and a second component comprising a polyol comprising at least two alcoholic hydroxyl functional groups per molecule. The eutectic mixture can be an equilibrium phase between the first component and the second component. A molar ratio of the first component to the second component in the eutectic mixture can range from 1:1 to 1:9.

The eutectic mixture can exhibit a glass transition temperature of no higher than −70° C., a viscosity index of at least 60, and a kinematic viscosity at 100° C. in a range from 2.0 to 40 cSt.

DETAILED DESCRIPTION

Definitions

Figure 1:
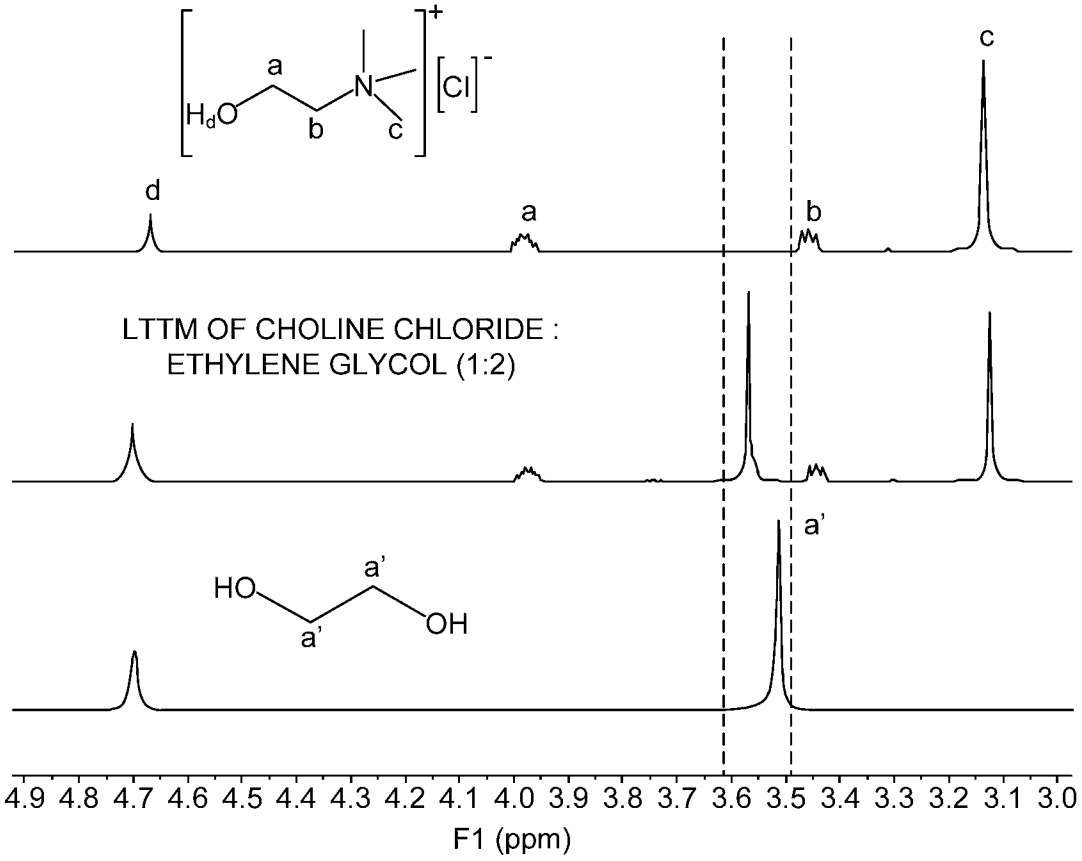
FIG. 1 shows portions of a NMR spectra of the LTTM of Example 1.
Figure 1:
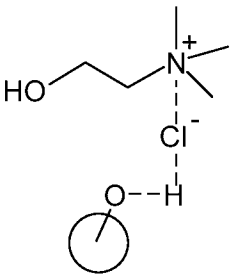

All numerical values within the detailed description and the claims herein are modified by "about" or "approximately" the indicated value, and take into account experimental error and variations that would be expected by a person having ordinary skill in the art.

As used herein, the term "low-transition-temperature material" ("LTTM") means a material having a glass transition temperature measured by using DSC of no higher than −50° C.

As used herein, the abbreviation "DSC" stands for differential scanning calorimetry.

As used herein, the term "choline chloride" (also abbreviated as "CC") means a compound having a structure corresponding to the following general formula:

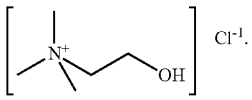

2-hydroxy-N, N, N-trimethylethan-1-aminium chloride

Betaine as used in the present disclosure has the following structure:

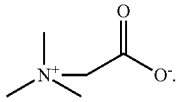

2-(trimethylammonio) acetate

As used herein, a polyol refers to an organic compound comprising at least two alcoholic hydroxyl (—OH) groups per molecule which can be represented by the formula HO—R—OH, where the two hydroxyls are alcoholic (i.e., not a part of a carboxylic acid group), and the linking moiety —R— can be a $—CR^1{}_m—CR^2{}_n—$ moiety or a $—CR^1{}_m—R_3—CR^2{}_n—$ moiety, wherein: $R^1$ and $R^2$ can be, independently at each occurrence, a hydrogen, a saturated or unsaturated, substituted or unsubstituted, linear or cyclic aliphatic hydrocarbyl group, or a substituted or unsubstituted aromatic hydrocarbyl group, or alternatively, one or more of the $R^1$, $R^2$ and the intermediate atoms and moieties in between may, taken together, form a cyclic moiety that is saturated or unsaturated, aliphatic or aromatic, with or without containing a heteroatom therein; $R^3$ can be any double-valency linking moiety; and m and n can be any suitable integers. A polyol described above where $R^1$, $R^2$, and $R^3$ do not contain an additional alcoholic hydroxyl is a glycol. A polyol described above is a glycerol where $R^3$ is represented by:

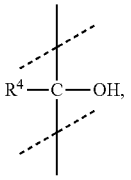

where $R^4$ is a linear, branched, or cyclic, saturated or unsaturated, substituted or unsubstituted, hydrocarbyl group.

An aliphatic polyol herein refers to a polyol containing at least two alcoholic hydroxyl groups directly connected to carbon atom(s) that do not form part of an aromatic structure.

An aromatic polyol herein refers to a polyol containing at least two alcoholic hydroxyl groups, at least one of which is directly connected to a carbon atom that forms part of one or more aromatic structure(s). Examples of aromatic polyols include, but are not limited to: 1,2-benzenediol (catechol), 1,3-benzenediol (resorcinol), 1,4-dihydroxybenzene (hydroquinone), benzene-1,2,3-triol, benzene-1,2,4-triol; benzene-1,2,5-triol, benzene-1,3,5-triol, and the like. An "analogue" of an aromatic polyol is an aromatic polyol comprising, in addition to the basic alcohol structure of the aromatic polyol, one or more aliphatic groups (linear, branched, or cyclic) connected directly to the aromatic structure.

A "eutectic mixture" as used herein refers to a mixture comprising two or more compounds which interact with each other to prevent the crystallization of each compound individually, resulting in a system having a melting point or a glass transition temperature lower than the normal melting points of the individual compounds in their pure forms.

As used herein, the term "lubricant" refers to a substance that can be introduced between two or more surfaces and lowers the level of friction between two adjacent surfaces moving relative to each other. A lubricant "base stock" is a material, typically a fluid at the operating temperature of the lubricant, used to formulate a lubricant by admixing with other components. Non-limiting examples of base stocks suitable in lubricants include API Group I, Group II, Group III, Group IV, and Group V base stocks. PAOs, particularly hydrogenated PAOs, have recently found wide use in lubricant formulations as a Group IV base stock, and are particularly preferred.

In the present disclosure, all kinematic viscosity at 100° C. ("KV100") and kinematic viscosity at 40° C. ("KV40") are measured using ASTM D445. Viscosity index ("VI") is determined according to ASTM D2270. Pour points are determined using ASTM D97.

Overview

In various aspects, low transition temperature mixtures (LTTMs) based on polyols including two or more alcoholic hydroxyl groups per molecule (i.e., a polyol) are provided. The polyol-based LTTMs can provide various beneficial properties, such as high viscosity index values, low glass transition temperatures relative to the phase transition properties of the mixture components, and/or high kinematic viscosities, especially in view of the typically small molecular weight of the mixture components. Additionally or alternately, glycol-based LTTMs (such as ethylene glycol-based LTTMs) can have exceptional stability in properties even when water is incorporated into the mixture at a non-negligible quantity. The number of carbon atoms per molecule in the compound including two or more hydroxyl groups can be at most: 6, 5, 4, 3, or 2.

In addition to a polyol, the LTTMs also include a quaternary amine that includes at most 6, or at most 5, or at most 4, or at most 3, carbon atoms per molecule, such as choline chloride or betaine. The molar ratio of polyol to quaternary amine in the resulting eutectic mixture can depend on the nature of the respective compounds. Examples of suitable molar ratios of quaternary amine to polyol can range from 1:1 to 1:10 or from 1:1 to 1:9 or from 1:2 to 1:9 or from 1:1 to 1:4 or from 1:4 to 1:10 or from 1:4 to 1:9. Examples of particularly useful quaternary amines for the LTTMs, eutectic mixtures and/or base stocks according to the present disclosure are choline chloride ("CC"), betaine, and mixtures and combinations thereof.

The low transition temperature mixtures based on a eutectic mixture of the quaternary amine and the polyol can have beneficial properties for use as a lubricant base stock. For example, the LTTMs can have a VI of at least 60, or at least 80, or at least 100, or at least 120, or at least 140, such as up to 180 or more. Additionally or alternately, the LTTMs can have a KV100 of 2.0 to 40 cSt, or 2.0 to 30 cSt, or 2.0 to 10 cSt, or 2.0 to 6.0 cSt, or 2.0 to 4.0 cSt, or 4.0 to 40 cSt, or 4.0 to 30 cSt, or 4.0 to 6.0 cSt. The LTTMs can have lower glass transition temperatures compared to the melting points and/or glass transition temperatures of the components forming the eutectic mixture. For example, the glass transition temperature of the LTTM can be no higher than: −70° C., −75° C., −80° C., −85° C., −90° C., −95° C., −100° C., −105° C., −110° C., or even −120° C.

Specific examples of the LTTMs of the present disclosure are mixtures of quaternary amines with glycols (such as ethylene glycol, "EG") and mixtures of quaternary amines with glycerols (such as 1,2,3-propanetriol). Examples of useful glycols include, but are not limited to: ethylene glycol, propylene glycol, propane-1,2-diol, butane-1,4-diol, butane-2,3-diol, butane-1,3-diol, pentane-1,5-diol, pentane-1,4-diol, pentane-1,3-diol, pentane-1,2-diol, pentane-2,3-diol, pentane-2,4-diol, hexane-1,2-diol, hexane-1,3-diol, hexane-1,4-diol, hexane-1,5-diol, hexane-1,6-diol, hexane-2,3-diol, hexane-2,4-diol, hexane-2,5-diol, and hexane-3,4-diol.

A particularly useful glycol for the LTTMs of the present disclosure is ethylene glycol due to, among others, its commercial availability and ease of use. The molar ratio of the quaternary amine to ethylene glycol in the LTTMs can range from, e.g., 1:2 to 1:9, or 1:2 to 1:4. LTTMs made from choline chloride ("CC"), betaine, or mixtures and combinations thereof as the quaternary amine and ethylene glycol can exhibit unusual properties. For example, depending on the ratio, the VI of a CC/EG LTTM can be at least 90, or at least 100, or at least 110, or at least 120, such as up to 200 or more. In particular, at a molar ratio of choline chloride to ethylene glycol of 1:2, the VI of the resulting LTTM can be from 170 to 180. The glass transition temperature of LTTMs made using ethylene glycol can also be low. For example, the glass transition temperature can be no higher than −90° C., or no higher than −100° C., or no higher than −110° C.

In other aspects, the low-transition-temperature mixtures can correspond to mixtures of a quaternary amine with an aromatic polyol, such as catechol, resorcinol, benzene-1,2,3-triol, benzene-1,2,4-triol; benzene-1,2,5-triol, benzene-1,3,5-triol, and the like. The molar ratio of quaternary amine to aromatic polyols can range from 1:1 to 1:4, or 1:1 to 1:2. Such LTTMs can exhibit highly desirable properties. For example, depending on the ratio, the VI of the LTTM can be at least 60, or at least 80, such as up to 200 or more. The glass transition temperature of LTTMs made using ethylene glycol can also be low. For example, the glass transition temperature can be no higher than −70° C. The LTTMs can also have an unusually high KV100 of at least 20 cSt, or in the range from 20 to 30 cSt.

The fluid mixtures corresponding to LTTMs may show (eutectic) melting points (a phase transition) or preferably may show glass transitions instead in DSC diagrams. The molar ratio of quaternary amine to aromatic polyol can range from 1:1 to 1:4, or 1:1 to 1:2, or 1:2 to 1:4. Such LTTMs based on aromatic polyol can exhibit highly desirable properties and/or combinations thereof, for example: glass transition temperature no higher than −70° C.; KV100 of at least 4.0 cSt, or at least 10 cSt; and VI of at least 70, or at least 80, or at least 90.

Formation of LLTMs

The LTTMs of the present disclosure are particularly useful as synthetic base stocks and/or as lubricant additives for lubricant compositions. In some examples the LTTM of the present disclosure can be anhydrous, while in others the LTTM can remain stable while incorporating 0.1 to 5.0 wt % water, or 0.1 to 3.0 wt %.

A method for making a eutectic mixture described above can start with a component that is a liquid at room temperature. Alternatively and additionally, the process can include a step of heating a component having the lowest melting point to the temperature at which it melts. The remaining component or components can then be dissolved in the liquid or melted component. The mixtures of the disclosure are referred to as "eutectic mixtures" which for purposes of the present disclosure means an equilibrium phase between two or more components, which equilibrium phase, or mixture, has different physical characteristics than the individual components.

The eutectic mixtures described herein are desirably formed, e.g., in the absence of any additional solvent that dissolves both compounds. To be successfully combined, the individual components must be compatible, i.e., each compound must form an intermolecular interaction with the other, so that this interaction will counteract the usual forces that tend to arrange the individual components into their individual crystalline forms. Without being bound by any particular theory, it is believed that this result is only obtainable when the components are mixed on the molecular level.

The lube acceptable eutectic mixtures of this disclosure can be prepared under various pre-defined conditions. The mixtures of the disclosure can also provide for delivery of potential additives in a controlled fashion or controlled release manner that has limited solubility in lubes. The delivery can be triggered, for example by either heat, moisture, or other solvent. These LTTMs can potentially overcome some of the limitations of ionic liquids such as their potential toxicity, high cost and difficulties in getting fluids in high purity. These mixtures may have the advantage of being inexpensive, and easy to prepare from natural and readily available starting materials.

In a comparison of ionic liquids with LTTMs, the ionic liquids are ionic compounds while LTTMs are mixtures. In ionic liquids the crystallization can be avoided via the choice of unsymmetrical organic cations and anions; whereas in LTTMs it is hydrogen bonding or van der Waals forces that interfere with the ability of the initial compounds to crystallize. Limitations of ionic liquids include, for example, high cost and difficulties in getting ionic liquid fluids in high purity. LTTMs have advantage of being inexpensive, easy to prepare from natural materials, and readily available starting materials.

Illustrative advantages of the LTTMs of this disclosure include, for example, inexpensive and easy preparation, renewable and biodegradable, wide liquid range, good solvation properties, ability to customize properties as a function of constituents nature and ratio and conditions applied, and easy recovery using an anti-solvent.

The compositions of this disclosure can be prepared by a process that involves providing at least a first component and at least a second component. Optionally, at least one of first component and the second component can be a solid 20° C. The process further involves heating the first component and/or the second component. If both of the components are solid at room temperature, whichever component has the lowest melting point can be heated to a temperature sufficient to melt the component. In such cases, the remaining component(s) can then be dissolved in the melted component. The heating of the components in a liquid state can provide sufficient molecular mixing to form a eutectic mixture.

Process conditions for the preparation of the eutectic mixtures of this disclosure, such as temperature, pressure and contact time, may also vary greatly and any suitable combination of such conditions may be employed herein. The reaction temperature may range from −10° C. to 250° C., and preferably from 0° C. to 200° C., and more preferably from 25° C. to 150° C. Normally the reaction is carried out under ambient pressure and the contact time may vary from a matter of seconds or minutes to a few hours or greater. The reactants can be added to the reaction mixture or combined in any order. The stir time employed can range from 0.5 to 72 hours, preferably from 1 to 36 hours, and more preferably from 2 to 24 hours.

Examples of techniques that can be employed to characterize the compositions formed by the process described above include, but are not limited to, analytical gas chromatography, FTIR spectroscopy, nuclear magnetic resonance, thermogravimetric analysis (TGA), inductively coupled plasma mass spectrometry, differential scanning calorimetry (DSC), volatility and viscosity measurements.

This disclosure provides lubricating oils comprising a component having a composition capable of forming a eutectic mixture described above when not mixed with other components of the oil. The lubricating oils comprise a primary lubricant base stock and a secondary lubricant component having a composition, if not added to the lubricant, capable of forming a eutectic mixture described above. The primary lubricant base stock may constitute, based on the total weight of the lubricant oil, from c1 to c2 wt %, where c1 and c2 can be, independently, 50, 55, 60, 65, 70, 75, 80, 85, 90, 95, as long as c1<c2. The secondary lubricant component, which can be a co-base stock, an additive, or other component, may constitute, based on the total weight of the lubricant oil, from c3 to c4 wt %, where c3 and c4 can be, independently, 0.1, 0.2, 0.4, 0.5, 0.6, 0.8, 1.0, 2.0, 4.0, 5.0, 6.0, 8.0, 10, 15, 20, as long as c3<c4.

The lubricant oils of the present disclosure are useful as, e.g., automotive engine oils, gear box oils, transmission oils, power-line oils, industrial lubricant oils and greases, industrial gear box oils, wind turbine lubricant oil, and in other applications. The lubricant oil can have excellent solvency and dispersancy characteristics. The lubricating oil base stock can be any oil boiling in the lube oil boiling range, typically from 100° C. to 450° C. In the present specification and claims, the terms base oil(s) and base stock(s) are used interchangeably.

The lubricant oil of the present disclosure can be formulated by combining a pre-fabricated eutectic mixture described above with other components such as other base oils, additives, and the like. The pre-fabricated eutectic mixture can be a co-base stock, an additive, or other component of the final lubricant oil composition. Additionally or alternatively, the lubricant oil can be formulated by combining the first component, the second component and other optional components of the eutectic mixture at the quantities desirable for making the eutectic mixture with other components of the lubricant oil such as other base oils, additives, and the like.

When a eutectic mixture of the present disclosure is included in a lubricant oil composition, it has been found that wear control of the lubricated surfaces can be improved, friction can be reduced, and fuel efficiency can be maintained or improved as compared to wear control, friction reduction and fuel efficiency achieved using a lubricating engine oil containing a co-base stock other than the eutectic mixture co-base stock.

Other Lubricating Oil Base Stocks

A wide range of lubricating base oils known in the art can be used in combination with the eutectic mixture in a lubricant oil composition. Examples of lubricating base oils that are useful in the present disclosure are natural oils, mineral oils and synthetic oils, and unconventional oils (or mixtures thereof) can be used unrefined, refined, or re-refined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Re-refined oils are obtained by processes analogous to refined oils but using an oil that has been previously used as a feed stock. Groups I, II, III, IV and V are broad base oil stock categories developed and defined by the American Petroleum Institute (API Publication 1509; www.API.org) to create guidelines for lubricant base oils. Group I base stocks have a VI in the range from 80 to 120 and contain greater than 0.03% sulfur and/or less than 90% saturates. Group II base stocks have a VI in the range from 80 to 120, and contain less than or equal to 0.03% sulfur and greater than or equal to 90% saturates. Group III stocks have a VI greater than 120 and contain less than or equal to 0.03% sulfur and greater than 90% saturates. Group IV includes PAOs. Group V base stock includes base stocks not included in Groups I-IV.

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked base stocks, including synthetic oils such as alkyl aromatics and synthetic esters are also well known base stock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alpha-olefin copolymers, for example). PAO base stocks are commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The number of average molecular weights of the PAOs can vary from roughly 250 to 10,000, although PAO's may be made in KV100 as high as 1,000 cSt. The PAOs are typically comprised of relatively low molecular weight hydrogenated polymers or oligomers of alpha-olefins which include, but are not limited to, $C_2$ to approximately $C_{32}$ alpha-olefins with the $C_8$ to $C_{16}$ alpha-olefins, such as 1-octene, 1-decene, 1-dodecene and the like, being preferred. The preferred polyalpha-olefins are poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity base stocks of acceptably low volatility. Depending on the viscosity grade and the starting oligomer, the PAOs may be predominantly trimers and tetramers of the starting olefins, with minor amounts of the higher oligomers, having a viscosity range of 1.5 to 12 cSt. PAO fluids of particular use may include 3.0 cSt, 3.4 cSt, and/or 3.6 cSt and combinations thereof. Mixtures of PAO fluids having a viscosity range of 1.5 to approximately 150 cSt or more may be used if desired.

The PAO fluids may be conveniently made by the polymerization of an alpha-olefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

Other useful lubricant oil base stocks include wax isomerate base stocks and base oils, comprising hydroisomerized waxy stocks (e.g. waxy stocks such as gas oils, slack waxes, fuels hydrocracker bottoms, etc.), hydroisomerized Fischer-Tropsch waxes, Gas-to-Liquids (GTL) base stocks and base oils, and other wax isomerate hydroisomerized base stocks and base oils, or mixtures thereof. Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. For example, one useful catalyst is ZSM-48 as described in U.S. Pat. No. 5,075,269, the disclosure of which is incorporated herein by reference in its entirety. Processes for making hydrocracked/hydroisomerized distillates and hydrocracked/hydroisomerized waxes are described, for example, in U.S. Pat. Nos. 2,817,693; 4,975,177; 4,921,594 and 4,897,178 as well as in British Patent Nos. 1,429,494; 1,350,257; 1,440,230 and 1,390,359. Each of the aforementioned patents are incorporated herein in their entirety. Particularly favorable processes are described in European Patent Nos. 464546 and 464547, also incorporated herein by reference. Processes using Fischer-Tropsch wax feeds are described in U.S. Pat. Nos. 4,594,172 and 4,943,672, the disclosures of which are incorporated herein by reference in their entirety.

Gas-to-Liquids (GTL) base oils, Fischer-Tropsch wax derived base oils, and other wax-derived hydroisomerized (wax isomerate) base oils be advantageously used in the instant disclosure, and may have useful KV100 in the range from 3 to 50 cSt, preferably from 3 to 30 cSt, more preferably from 3.5 to 25 cSt, as exemplified by GTL 4 with a KV100 of approximately 4.0 cSt a VI of approximately 141. These Gas-to-Liquids (GTL) base oils, Fischer-Tropsch wax derived base oils, and other wax-derived hydroisomerized base oils may have useful pour points of −20° C. or lower, and under some conditions may have advantageous pour points of −25° C. or lower, with useful pour points of −30° C. to −40° C. or lower. Useful compositions of Gas-to-Liquids (GTL) base oils, Fischer-Tropsch wax derived base oils, and wax-derived hydroisomerized base oils are recited in U.S. Pat. Nos. 6,080,301; 6,090,989, and 6,165,949 for example, and are incorporated herein in their entirety by reference.

The hydrocarbyl aromatics can be used as a base oil or base oil component and can be any hydrocarbyl molecule that contains at least 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from $C_6$ up to $C_{60}$ with a range of $C_8$ to $C_{20}$ often being preferred. A mixture of hydrocarbyl groups are often preferred, and up to three such substituents may be present. The hydrocarbyl group can optionally contain sulfur, oxygen, and/or nitrogen containing substituents. The aromatic group can also be derived from natural (petroleum) sources, provided at least (roughly) 5% of the molecule is comprised of an above-type aromatic moiety. KV100 of approximately 3 to 50 cSt are preferred, with KV100 of approximately 3.4 to 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be 2% to 25%, preferably 4% to 20%, and more preferably 4% to 15%, depending on the application.

Alkylated aromatics such as the hydrocarbyl aromatics of the present disclosure may be produced by well-known Friedel-Crafts alkylation of aromatic compounds. See Friedel-Crafts and Related Reactions, Olah, G. A. (ed.), Interscience Publishers, New York, 1963. For example, an aromatic compound, such as benzene or naphthalene, is alkylated by an olefin, alkyl halide or alcohol in the presence of a Friedel-Crafts catalyst. See Friedel-Crafts and Related Reactions, Vol. 2, part 1, chapters 14, 17, and 18, See Olah, G. A. (ed.), Inter-science Publishers, N.Y., 1964. Many homogeneous or heterogeneous, solid catalysts are known to one skilled in the art. The choice of catalyst depends on the reactivity of the starting materials and product quality requirements. For example, strong acids such as $AlCl_3$, $BF_3$, or HF may be used. In some cases, milder catalysts such as $FeCl_3$ or $SnCl_4$ are preferred. Newer alkylation technology uses zeolites or solid super acids.

Esters comprise a useful base stock. Additive solvency and seal compatibility characteristics may be secured by the use of esters such as the esters of dibasic acids with monoalkanols and the polyol esters of mono-carboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from 5 to 10 carbon atoms. These esters are widely available commercially, for example, the Mobil P-41 and P-51 esters of ExxonMobil Chemical Company.

Also useful are esters derived from renewable material such as coconut, palm, rapeseed, soy, sunflower and the like. These esters may be monoesters, di-esters, polyol esters, complex esters, or mixtures thereof. These esters are widely available commercially, for example, the Mobil P-51 ester of ExxonMobil Chemical Company.

Engine oil formulations containing renewable esters are included in this disclosure. For such formulations, the renewable content of the ester is typically greater than 70 wt %, preferably more than 80 wt % and most preferably more than 90 wt %.

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; and (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing, dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having a KV100 in the range from 2 $mm^2/s$ to 50 $mm^2/s$. They are further characterized typically as having pour points of −5° C. to −40° C. or lower. They are also characterized typically as having viscosity indices of 80 to 140 or greater.

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

Base oils for use in the formulated lubricating oils useful in the present disclosure are any of the variety of oils corresponding to API Group I, Group II, Group III, Group IV, and Group V oils and mixtures thereof, preferably API Group II, Group III, Group IV, and Group V oils and mixtures thereof, more preferably the Group III to Group V base oils due to their exceptional volatility, stability, viscometric and cleanliness features. Minor quantities of Group I stock, such as the amount used to dilute additives for blending into formulated lube oil products, can be tolerated but should be kept to a minimum, i.e., amounts only associated with their use as diluent/carrier oil for additives used on an "as-received" basis. Even in regard to the Group II stocks, it is preferred that the Group II stock be in the higher quality range associated with that stock, i.e., a Group II stock having a VI in the range of 100 to 120.

The base oil constitutes the major component of the engine oil lubricant composition of the present disclosure and typically is present in an amount ranging from ~50 to ~99 wt %, preferably from 70 to 95 wt % (or 70 to 99 wt %), and more preferably from 80 to 95 wt % (or 80 to 99 wt %), based on the total weight of the composition. The base oil may be selected from any of the synthetic or natural oils typically used as crankcase lubricating oils for spark-ignited and compression-ignited engines. The base oil conveniently has a KV100 in the range from 2.5 to 12 cSt, preferably form 2.5 to 9 cSt. Mixtures of synthetic and natural base oils may be used if desired. Bi-modal mixtures of Group I, II, III, IV, and/or V base stocks may be used if desired.

Other Additives

A formulated lubricating oil may additionally contain one or more of the other commonly used lubricating oil performance additives including but not limited to detergents, anti-wear additives, dispersants, viscosity modifiers, corrosion inhibitors, rust inhibitors, metal deactivators, extreme pressure additives, anti-seizure agents, wax modifiers, viscosity modifiers, fluid-loss additives, seal compatibility agents, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973); see also U.S. Pat. No. 7,704,930, the disclosure of which is incorporated herein in its entirety. These additives are commonly delivered with varying amounts of diluent oil that may range from 5 to 50 wt % of the total weight of an additive package.

The additives useful in this disclosure do not have to be soluble in the lubricating oils. Insoluble additives such as zinc stearate in oil can be dispersed in the lubricating oils of this disclosure.

The types and quantities of performance additives used in combination with the instant disclosure in lubricant compositions are not limited by the examples shown herein as illustrations.

When lubricating oil compositions contain one or more of the additives discussed above, the additive(s) are blended into the composition in an amount sufficient for it to perform its intended function. Typical amounts of such additives useful in the present disclosure are shown in Table 1 below.

TABLE 1

| Component | Useful Quantity (wt %) | Preferred Quantity (wt %) |
|---|---|---|
| Dispersant | 0.1-20 | 0.1-8 |
| Detergent | 0.1-20 | 0.1-8 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |
| Anti-foam Agent | 0.001-3 | 0.001-0.15 |
| Viscosity Index Improver (pure polymer basis) | 0.0-8 | 0.1-6 |
| Anti-wear agent | 0.1-2 | 0.5-1 |
| Inhibitor and Antirust | 0.01-5 | 0.01-1.5 |

Many of the additives are shipped from the additive manufacturer as a concentrate, containing one or more additives together, with a certain amount of base oil diluents. Accordingly, the weight amounts in the table below, as well as other amounts mentioned herein, are directed to the amount of active ingredient (that is the non-diluent portion of the ingredient). The weight percentages (wt %) indicated below is based on the total weight of the lubricating oil composition, unless specified to the contrary.

The foregoing additives can be commercially available. These additives may be added independently but are usually pre-combined in packages which can be obtained from suppliers of lubricant oil additives. Additive packages with a variety of ingredients, proportions and characteristics are available and selection of the appropriate package will take the requisite use of the ultimate composition into account.

Examples of techniques that can be employed to characterize the compositions described herein include, but are not limited to, analytical gas chromatography (GC), Fourier transform infrared (FTIR) spectroscopy, infrared (IR) spectroscopy, nuclear magnetic resonance (NMR), thermogravimetric analysis (TGA), inductively coupled plasma mass spectrometry, differential scanning calorimetry (DSC), volatility and viscosity measurements.

The compositions and the lubricant oils of this disclosure are useful in a variety of applications. Illustrative applications include, but are not limited to: performance additives, separation fluids, analytics, syntheses, electrochemistry, engineering fluids, material syntheses, and the like. Illustrative performance additive applications include, for example, plasticizers, dispersing agents, compatibilizers, solubilizers, antistatic agents, gas hydrate inhibitors, enhance oil recovery, heavy hydrocarbon viscosity reducers, and the like. Illustrative separation applications include, for example, gas absorption/storage, extraction, carbon capture, ion containing polymer membranes, and the like. Illustrative analytic applications include, for example, gas chromatography columns, stationary phase for high pressure liquid chromatography, matrices for mass spectra, and the like. Illustrative synthesis applications include, for example, solvents, catalysis, biphasic reactions, manufacture of nanomaterials, and the like. Illustrative electrochemistry applications include, for example, electrolyte in batteries, electrolyte in sensors, metal plating, and the like. Illustrative engineering fluid applications include, for example, lubricants, thermal fluids, energy storage fluids, heat transfer fluids, and the like. Illustrative material synthesis applications include, for example, templates (also called structure-directing agents) in material synthesis and design of novel structures, and the like.

In the following examples, CC stands for choline chloride (MW: 139.62, melting point ("mp"): 302° C.), and EG stands for ethylene glycol ($HO—CH_2—CH_2—OH$) (MW 62.07, mp: −13° C.).

Example A—Overview of Lubricant Properties of LTTM Fluids

Table 2 shows compositions and properties for a series of inventive LTTM fluids and comparative materials. The molar ratio is that of the first component to the second component. In comparative Example 11, a LTTM was not formed at the specified molar ratio between the first and the second component. In Example 14, the composition further comprises water at about 2 wt %, based on the total weight of the composition of the LTTM. Details of the LTTM fluids in Table 2 are further described in the following examples. In comparative Example 15, a commercial polyalpha-olefin base stock (PAO5) is provided as a reference material for the LTTMs with similar KV40, KV100, and VI.

TABLE 2

| | Composition | | | Properties | | | |
|---|---|---|---|---|---|---|---|
| Example No. | First Component | Second Component | Molar ratio | KV100 (cSt) | KV40 (cSt) | Viscosity Index | Tg (° C.) |
| 1 | CC | EG | 1:2 | 5.27 | 22.67 | 177.1 | −117.19 |
| 2 | CC | EG | 1:4 | 3.31 | 13.13 | 125.0 | |
| 3 | CC | EG | 1:5 | 2.98 | 11.81 | 104.6 | −119.59 |
| 4 | CC | EG | 1:6 | 2.80 | 11.10 | 92.0 | |
| 5 | CC | EG | 1:9 | 2.53 | 10.18 | 61.7 | −118.99 |
| 6 | CC | Propylene Glycol | 1:4 | 4.64 | 27.50 | 73.3 | −107.08 |

TABLE 2-continued

| | Composition | | | Properties | | | |
|---|---|---|---|---|---|---|---|
| Example No. | First Component | Second Component | Molar ratio | KV100 (cSt) | KV40 (cSt) | Viscosity Index | Tg (° C.) |
| 7 | CC | 1,2-Hexanediol | 1:6 | 2.80 | 11.10 | 92.2 | |
| 8 | CC | Glycerol | 1:2 | 12.56 | 116.78 | 98.8 | −96.94 |
| 9 | CC | Glycerol | 1:2 | 12.42 | 114.47 | 99.2 | −97.49 |
| 10 | CC | Catechol | 1:1 | 25.56 | 504.22 | 60.4 | −75.26 |
| 11 | CC | Resorcinol | 1:1 | | | | |
| 12 | CC | Resorcinol | 1:2 | 22.7 | 343.88 | 80.7 | −73.73 |
| 13 | CC | EG | 1:2 | 5.40 | 23.47 | 177 | |
| 14 | CC | EG | 1:2 | 4.71 | 19.76 | 167 | |
| 15 | PAO5 | | | 5.10 | 25.00 | 138 | |

The general procedure for forming LTTMs included mixing the two starting materials in a round-bottom flask using a stirring rod. The mixing was optionally done under nitrogen atmosphere, such as for any starting materials that were hygroscopic. The mixtures were typically heated to 70-100° C. until all solids disappeared to make a homogenous solution. The liquid mixture was then cooled to room temperature. All DSC diagrams were obtained at a heating rate of 10° C. per minute.

Examples 1-5: Preparation of CC/EG LTTMs

Examples 1-5 correspond to LTTMs formed from CC and EG in molar ratios of 1:2, 1:4, 1:5, 1:6, and 1:9, respectively. It was observed that an LTTM did not form when CC and EG were mixed in a 1:1 ratio. The CC/EG LTTMs generally showed high VI values, and in particular, Example 1 shows a VI in the range from 170 to 180, which is exceptionally high. This high VI value is exceptionally high when considering the viscosity of the LTTM in Example 1. Example 15 shows an example of a commercial polyalpha-olefin synthetic base stock having a VI in the range from 130 to 140. More generally, in spite of the low molecular weight of the components, the LTTMs of Examples 1 to 5 all had KV100 in the range from 2.0 to 6.0 cSt and VI's of at least 60. For Examples 1, 3, and 5, the glass transition temperatures were lower than −110° C.

To form the LTTMs, 40 mmol (5.58 grams) CC and EG (80 mmol (4.97 grams), 160 mmol (9.94 grams), 200 mmol (12.43 grams), 240 mmol (14.91 grams), and 360 mmol (22.37 grams), respectively) were added to a 50 mL round-bottom flask. The components were heated to 70-80° C. while stirring until a homogenous liquid was formed.

Figure 2:
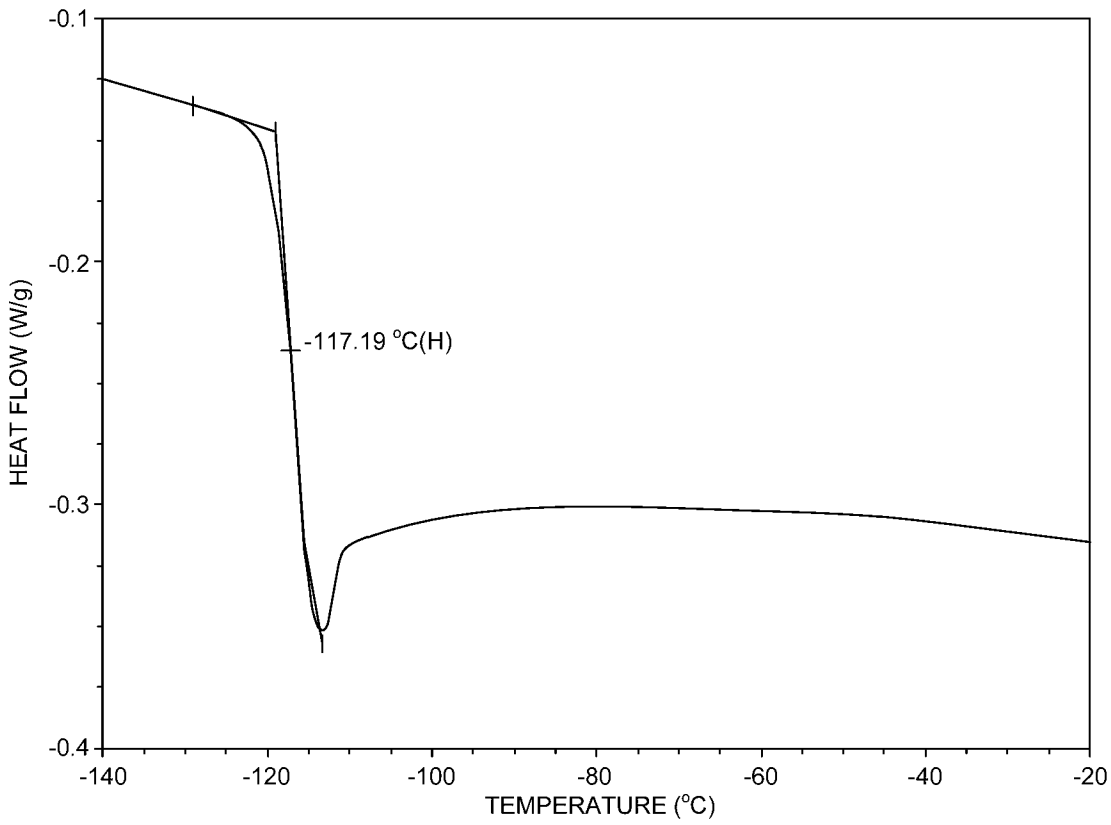
FIG. 2 shows a differential scanning calorimetry ("DSC") diagram of the LTTM of Example 1.
Figure 3:
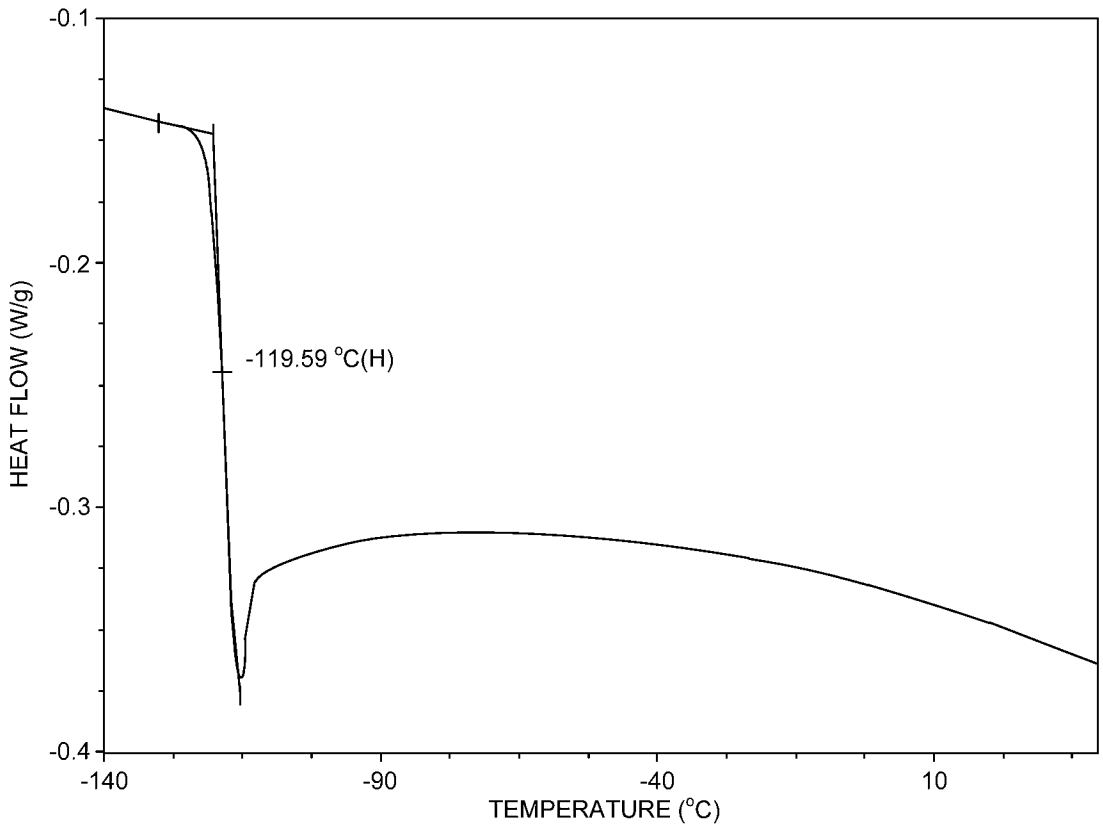
FIG. 3 shows a DSC diagram of the LTTM of Example 3.
Figure 4:
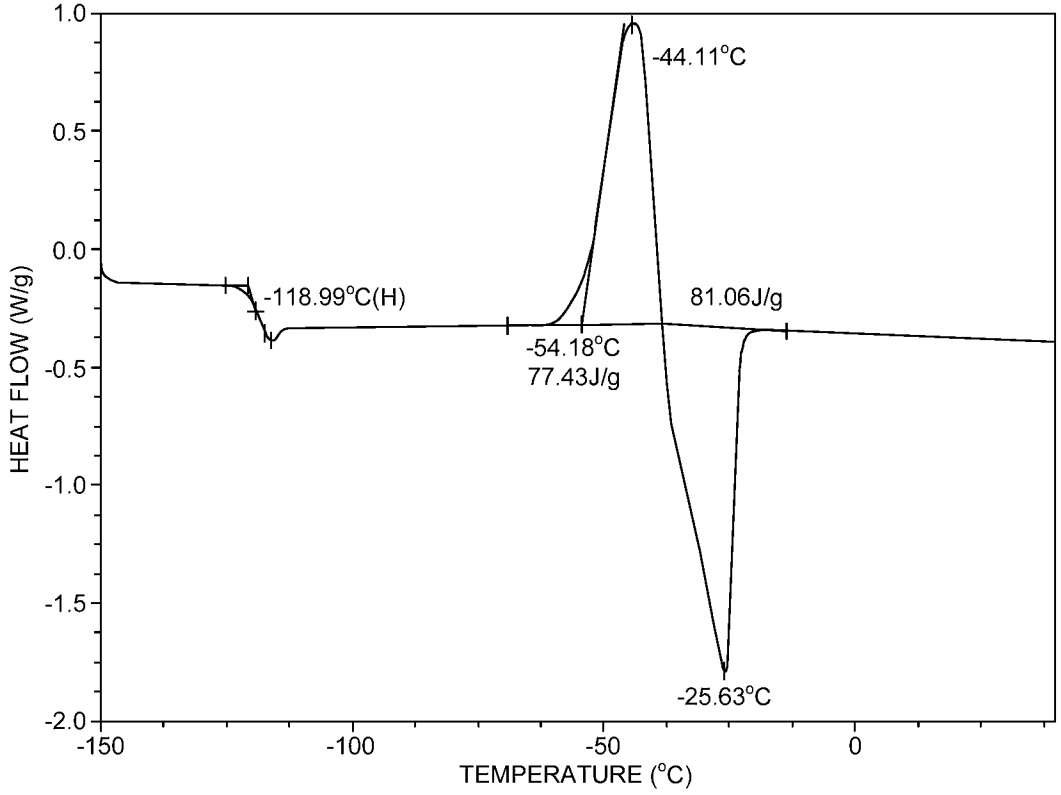
FIG. 4 shows a DSC diagram of the LTTM of Example 5.

FIG. 1 shows portions of NMR spectra from the LTTM formed from CC and EG at a molar ratio of the 1:2 (Example 1). The NMR spectra show the presence of CC and EG, as well as the presence of hydrogen bonding between the components. The downshift of EG peaks (a') indicates the effect due to hydrogen bond donation. FIG. 2 shows the DSC diagram of the LTTM of Example 1, which indicated a $T_g$ of −117.19° C. FIG. 3 shows the DSC diagram of the LTTM of Example 3, which indicated a $T_g$ of −119.59° C. FIG. 4 shows the DSC diagram of the LTTM of Example 5, which indicated a $T_g$ of −118.99° C. In FIG. 4, some additional peaks are present, including a peak corresponding to a melting point. Without being bound by any particular theory, it is believed that the additional peaks correspond to a non-participating component.

Example 6: Preparation of CC/Propylene Glycol LTTM

Figure 5:
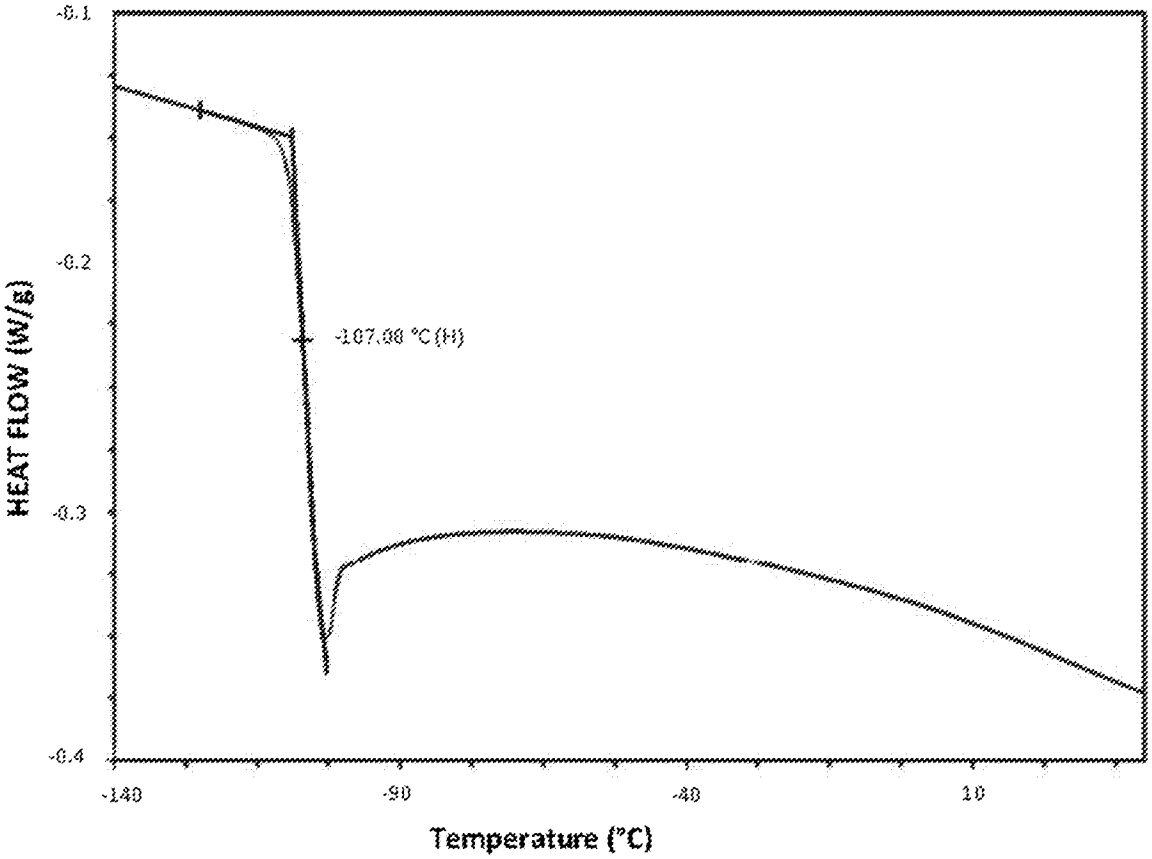
FIG. 5 shows a DSC diagram of the LTTM of Example 6.

Example 6 corresponds to an LTTM formed from CC and propylene glycol (HO—$CH_2CH_2CH_2OH$) (MW 76.09, mp: −59° C.) in a molar ratio of 1:4. The CC/propylene glycol LTTM showed a VI of at least 70 and a KV100 in the range from 4.0 to 5.0 cSt. The glass transition temperature was lower than −100° C., as shown in the DSC diagram in FIG. 5.

To form the LTTM, 40 mmol (5.58 grams) of CC and 160 mmol (12.17 grams) of propylene glycol were added to a 50 mL round-bottom flask. The components were heated to 70-80° C. while stirring until a homogenous liquid was formed.

Example 7: Preparation of CC/1,2-hexanediol LTTM

Example 7 corresponds to an LTTM formed from CC and 1,2-hexanediol in a molar ratio of 1:6. The CC/1,2-hexanediol LTTM showed a VI of at least 90 and a KV100 in the range from 2.0 to 3.0 cSt.

To form the LTTM, 40 mmol of CC and 240 mmol (28.36 grams) of 1,2-hexanediol (MW 118.17) were added to a 50 mL round-bottom flask. The components were heated to 70-80° C. while stirring until a homogenous liquid was formed.

Example 8 and 9: Preparation of CC/Glycerol LTTMs

Figure 6:
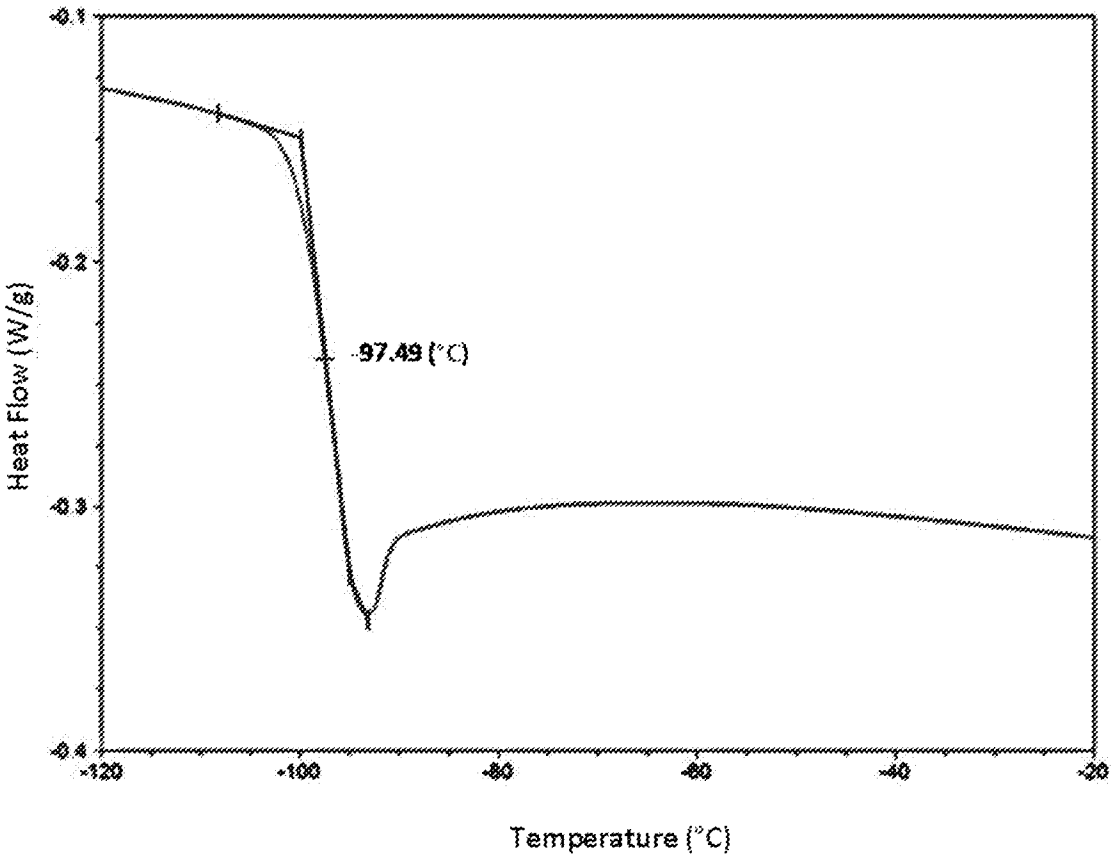
FIG. 6 shows a DSC diagram of the LTTM of Example 8.

Example 8 corresponds to an LTTM formed from CC and glycerol (MW 92.09, mp: 17.8° C.) in a molar ratio of 1:2. The glass transition temperature was lower than −90° C., as shown in the DSC diagram in FIG. 6.

In Example 8, 40 mmol of CC and 80 mmol (7.37 grams) of glycerol were added to a 50 mL round-bottom flask. The components were heated to 70-80° C. while stirring until a homogenous liquid was formed.

In Example 9, 3 ml of ethanol was also added to the flask. Instead of heating, the components were stirred without heating for 2 hours. The solvent was then removed by a rotary evaporator. In Example 9, ethanol was used as a solvent during formation of the LTTM. The CC/glycerol LTTMs showed a VI of at least 90 and a KV100 in the range of 10 to 15 cSt. The DSC diagram of this material (not shown) is very similar to that in FIG. 6 in shape and Tg, indicating that the LTTM prepared with and without an ethanol solvent were very similar.

Example 10: Preparation of CC/Catechol LTTM

Figure 7:
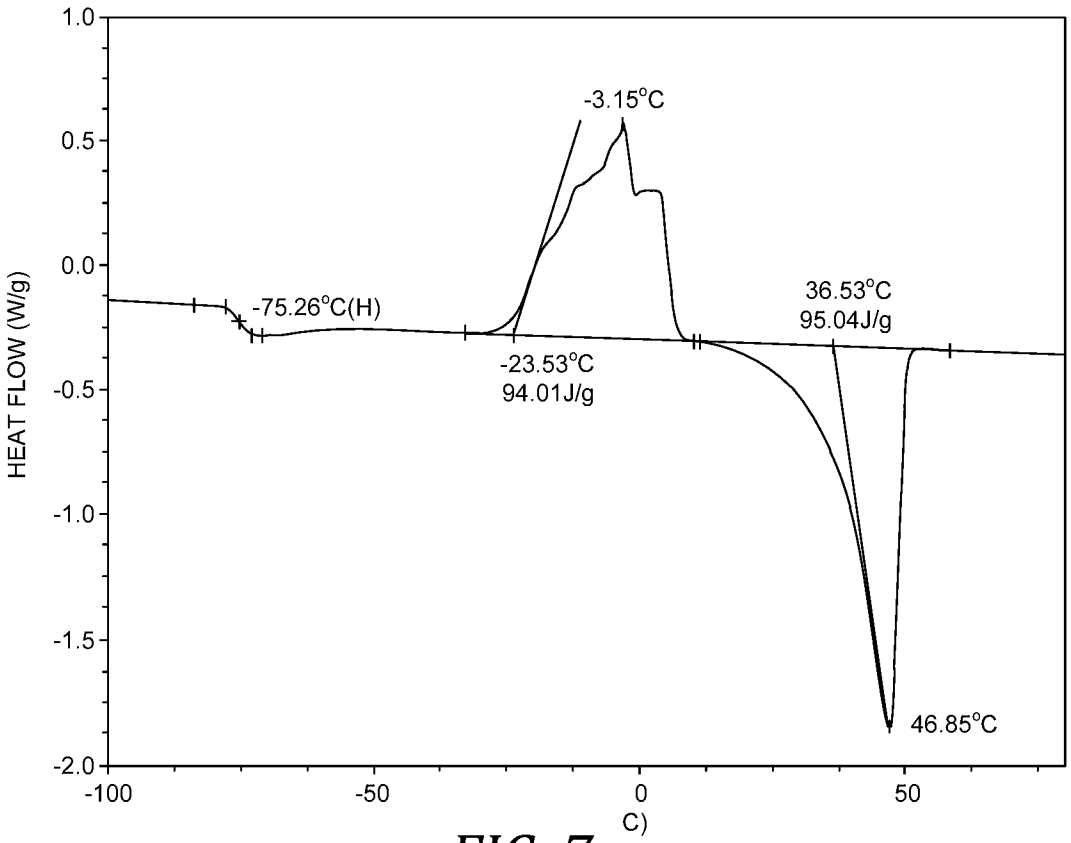
FIG. 7 shows a DSC diagram of the LTTM of Example 10.

Example 10 corresponds to an LTTM formed from CC and catechol (MW 110.11, mp: 100° C.) in a molar ratio of 1:1. An LTTM was not formed when a molar ratio of 1:2 was used. The CC/catechol LTTM showed a VI of at least 60 and a KV100 of from 20 to 30 cSt. The glass transition temperature was lower than −70° C., as shown in the DSC diagram in FIG. 7. The DSC diagram showed multiple peaks corresponding to both a glass transition and a melting phase transition. The DSC diagram in FIG. 7 included some other additional features, which are believed to correspond to a non-participating individual component.

To form the LTTM, 40 mmol of CC and 40 mmol (4.4 grams) of catechol were added to a 50 mL round-bottom flask. The components were heated to 100° C. while stirring until a homogenous liquid was formed.

Example 12: Preparation of CC/Resorcinol LTTMs

Figure 8:
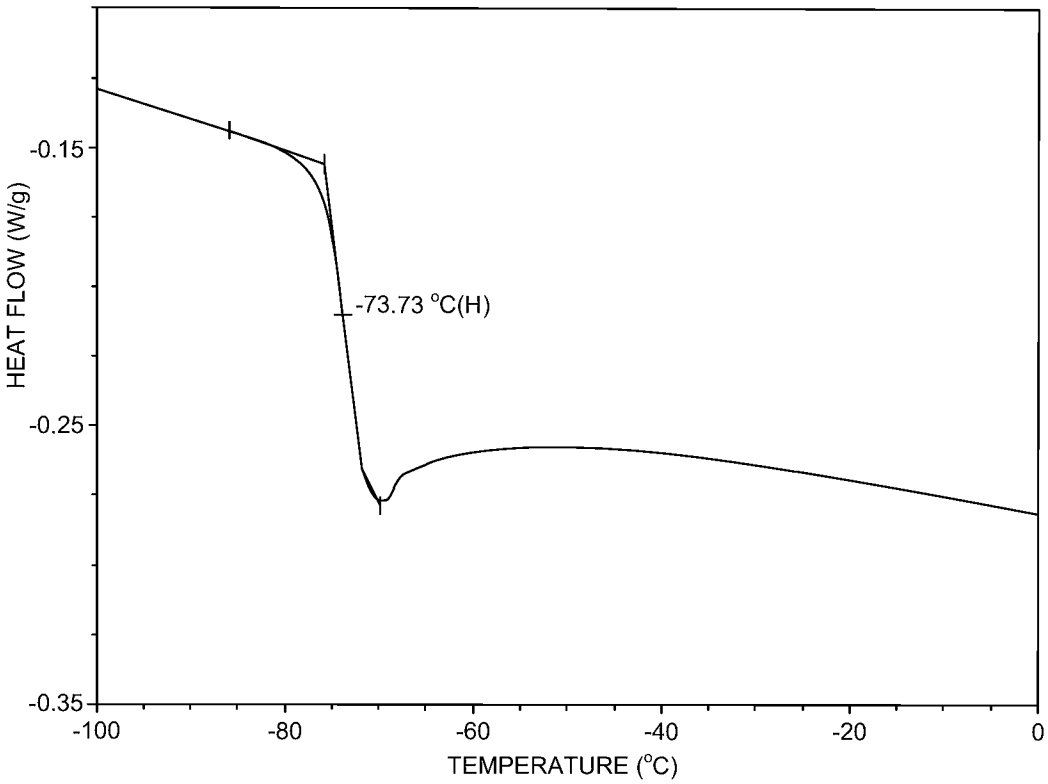
FIG. 8 shows a DSC diagram of the LTTM of Example 12.

Example 12 corresponds to an LTTM formed from CC and resorcinol (MW 110.11, mp: 109° C.) in a molar ratio of 1:2. An LTTM was not formed when a molar ratio of 1:1 was used, which corresponds to Example 11 in Table 2. The CC/resorcinol LTTM showed a VI of at least 80 and a KV100 in the range from 20 to 30 cSt. The glass transition temperature was lower than −70° C., as shown in the DSC diagram in FIG. 8. Considering the melting point of resorcinol at 109° C., this glass transition temperature of the mixture is exceptionally low.

To form the LTTM, 40 mmol of CC and 80 mmol (8.8 grams) of resorcinol were added to a 50 mL round-bottom flask. The components were heated to 100° C. while stirring until a homogenous liquid was formed.

Examples 13, 14, and 16: Preparation of Additional CC/EG LTTMs

In Example 13, a LTTM based on a 1:2 molar ratio of CC and EG was formed by adding 760 mmol of CC (106.1 grams) and 1520 mmol of EG (94.35 grams) to a 500 mL round-bottom flask. The components were heated to 70-80° C. while stirring until a homogenous liquid was formed. This resulted in an LTTM with properties similar to Example 1.

After making the LTTM in Example 13, 0.02 g of water was added to 1.0 g of the Example 13 LTTM. The resulting LTTM containing 2 wt % water is shown as Example 14. Although the viscosity is modestly reduced, the LTTM otherwise retains its unexpected properties.

For Example 16 (not shown in Table 2), a still larger scale batch of LTTM based on a 1:2 molar ratio of CC and EG was made by adding 106.1 g of CC (760.0 mmol) and 94.35 g of EG (1520.0 mmol) into a 500 mL round bottom flask. The components were heated at 70-80° C. while stirring until a homogenous liquid was formed. Similar to Examples 1 and 13, the resulting LTTM had a VI of 177, a KV100 of 5.4 cSt, and a KV40 of 23.5 cSt.

Figure 9:
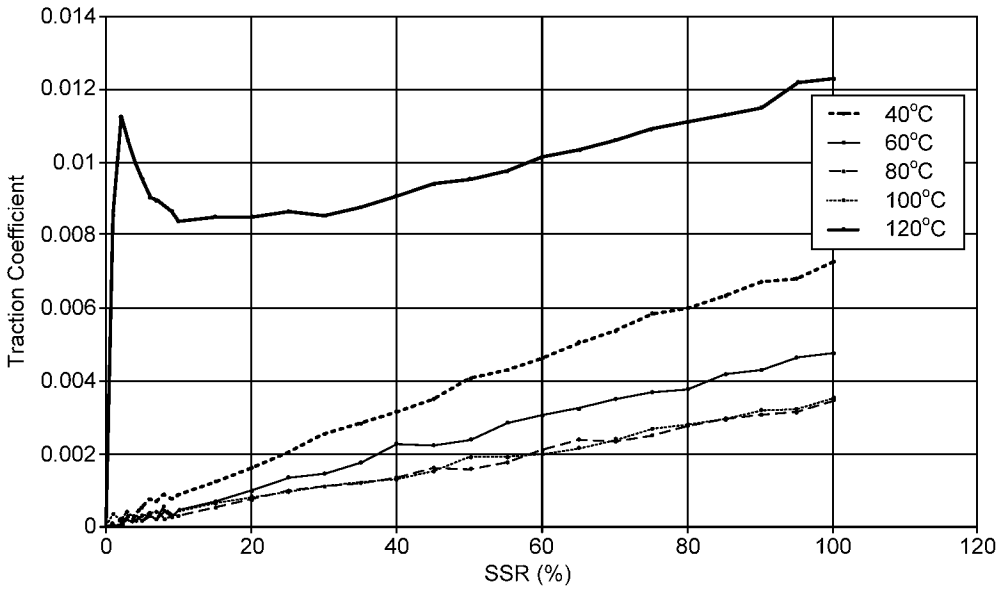
FIG. 9 shows traction curves of the LTTM of Example 16 comprising choline chloride and ethylene glycol at a molar ratio of 1:2 at a series of temperatures.

The LTTM of Example 16 was then evaluated in a mini traction machine ("MTM") obtainable from PCS Instruments of London, United Kingdom, for traction coefficient. FIG. 9 shows traction curves as a function of slide to roll ratio (SRR, expressed in terms of percentage of slide relative to roll) at a series of temperatures. In this test, the base stock was subjected to high pressure and high temperature when a stainless steel highly polished ball under high load was moved against a plate, both submerged into the fluids at the test temperature. The test started with the ball rolling at 100% then gradually sliding to a pure, 100% sliding mode at the end of test. The traction coefficient is an indication of the energy lost due to the base stock shearing. More energy efficient fluids have lower traction coefficients. The traction test was carried out at a pressure of 0.75 GPa, temperatures of 40, 60, 80, 100, and 120° C., respectively, at a rolling speed of 2 m/s rolling speed. Results shown as traction coefficient as a function of SRR (%) are provided in FIG. 9.

The LTTM fluid of Example 16 showed an unexpectedly low traction coefficient at the measured temperatures. As shown in FIG. 9, the traction coefficient for the LTTM of Example 16 was consistently lower than 0.008 at 40, 60, 80 and even 100° C. The low traction coefficient at such large temperature span renders the fluid particularly useful in lubricating oil compositions, which can translate into substantial energy savings during operation of equipment lubricated by such lubricants.

Example 17: Preparation of LTTMs from Betaine and EG

Example 17 corresponds to an LTTM formed from betaine (MW: 117.15, mp: ~293° C.) and EG in a molar ratio of 1:4. An LTTM was not formed when a molar ratio of 1:1 or 1:2 was used. Without being bound by any particular theory, this may be due to the higher polarity of betaine relative to CC. The betain/EG LTTM showed a VI of 95 (i.e., at least 90) and a KV100 of 4 to 6 cSt.

To form the LTTM, 40 mmol of betaine and 160 mmol of EG were added to a 50 mL round-bottom flask. The components were heated to 70-80° C. while stirring until a homogenous liquid was formed.

Figure 10:
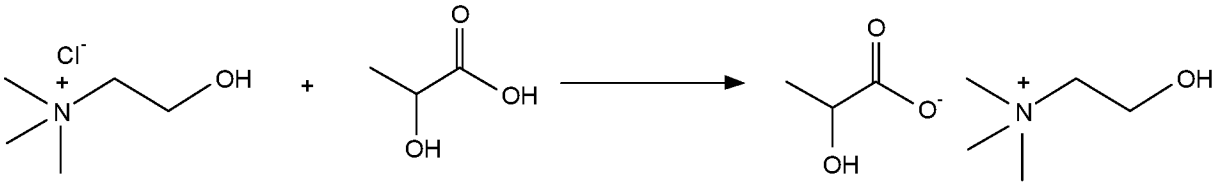
FIGS. 10 and 11 schematically show the interaction of the components in the comparative ionic liquid of Example 18 and the comparative LTTM of Example 19, respectively.
Figure 11:
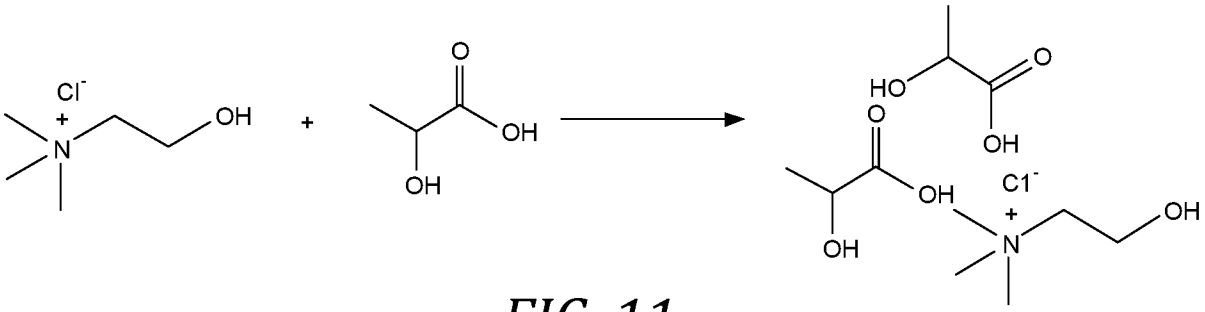

Comparative Examples 18 and 19: Preparation of CC/Lactic Acid Comparative LTTM and Ionic Liquid Examples 18 and 19 correspond to an ionic liquid and a comparative LTTM, respectively, both formed from CC and lactic acid. FIG. 10 schematically shows the components interacting with each other in an ionic liquid formed from lactic acid (MW: 90.08, mp: 16.8° C., boiling point ("bp"): 122° C.) and CC, while FIG. 11 shows the components interacting with each other in the corresponding LTTM at a 1:2 molar ratio of lactic acid and CC. The LTTM in Example 19 is comparative in that the second component (lactic acid) contains only one alcoholic hydroxyl group per molecule. While lactic acid comprises two hydroxyl groups in each molecule, the other one is not an alcoholic hydroxyl group insofar as it forms part of a carboxylic group.

Figure 12:
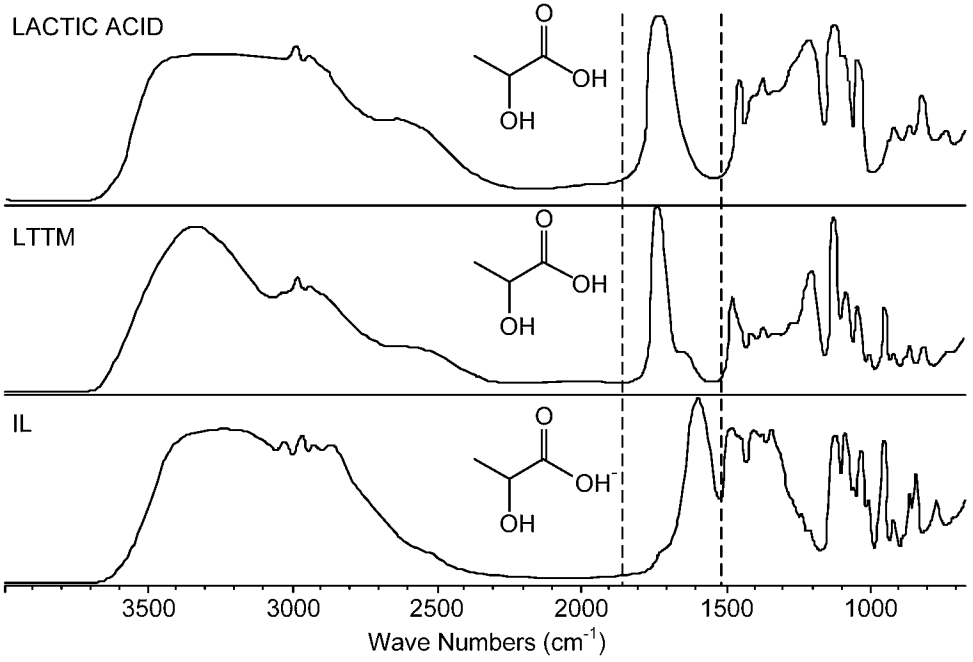
FIG. 12 shows Fourier Transform Infrared ("FTIR") spectra and DSC diagrams of the ionic liquid of comparative Example 18 and a comparative LTTM of comparative Example 19, respectively.

The ionic liquid was formed by conventional methods. For the LTTM, 20.0 mmol (2.79 grams) of CC and 40 mmol (3.6 grams) of lactic acid were added to a round-bottom flask and heated to 70-80° C. while stirring until a homogenous liquid was formed. The mixture was then cooled to room temperature. FTIR was used to characterize the ionic liquid, the LTTM, and the separate lactic acid component. The FTIR spectra are shown in FIG. 12. The LTTM shows only an acid peak at 1710 $cm^{-1}$, which is believed to correspond to the carbonyl peak for the acid group in the lactic acid, while the ionic liquid only shows the lactate peak from choline lactate at 1550 $cm^{-1}$ for the carbonyl group.

Figure 13:
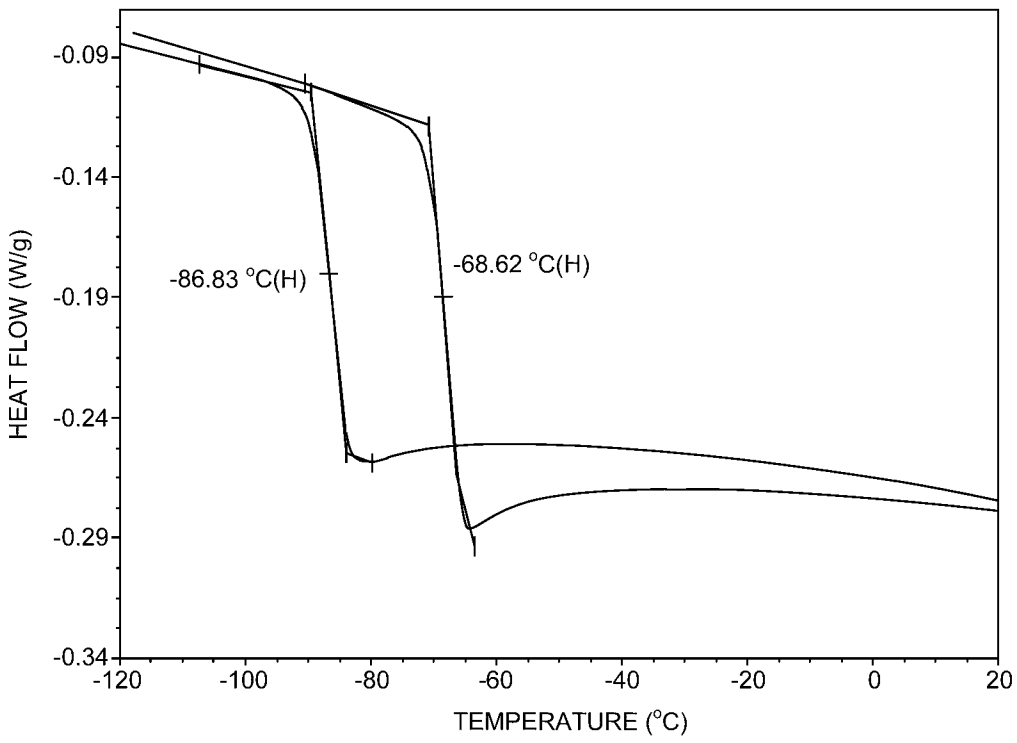
FIG. 13 shows DSC diagrams of an ionic liquid and an LTTM based on choline chloride and lactic acid, respectively.

FIG. 13 shows the DSC diagrams of the ionic liquid of comparative Example 18 and the LTTM of comparative Example 19. As shown, the ionic liquid had a Tg of −68.6° C. (curve on the right side at temperatures below about −70° C.), while the LTTM had a Tg of −86.6° C. (curve on the left side at temperatures below about −70° C.). The ionic liquid had a VI of 96, a KV100 of 32.9 cSt, and a KV40 of 513.74. The LTTM had a VI of 105.7, a KV100 of 9.6 cSt, and a KV40 of 74.8 cSt. While the comparative LTTM of Example 19 shows better performance than the ionic liquid in comparative Example 18, it nonetheless does not have performance as high as the LTTMs formed from ethylene glycol and CC in Examples 1, 13, and 16, above.

While the present invention has been described and illustrated with respect to certain aspects, it is to be understood that the invention is not limited to the particulars to disclosed and extends to all equivalents within the scope of the claims. Unless otherwise stated, all percentages, parts, ratios, etc. are by weight. Unless otherwise stated, a reference to a compound or component includes the compound or component by itself as well as in combination with other elements, compounds, or components, such as mixtures of compounds. Further, when an amount, concentration, or other value or parameter is given as a list of upper preferable values and lower preferable values, this is to be understood as specifically disclosing all ranges formed form any pair of an upper preferred value and a lower preferred value, regardless of whether ranges are separately disclosed. All patents, test procedures, and other documents cited herein, including priority documents, are fully incorporated by reference to the extent such disclosure is not inconsistent and for all jurisdictions in which such incorporation is permitted.

What is claimed is:

1. A composition comprising a eutectic mixture of:

a first component comprising a quaternary amine having at most 6 carbon atoms per molecule; and a second component comprising an ethylene glycol;

wherein a molar ratio of the first component to the second component in the mixture is in a range from 1:1 to 1:4, and the composition exhibits a glass transition temperature of no higher than −70° C., a viscosity index of at least 120, and a kinematic viscosity at 100° C. in a range from 2.0 to 10 cSt.

2. The composition of claim 1, wherein the molar ratio of the first component to the second component is in a range from 1:2 to 1:4.

3. The composition of claim 1, wherein the first component comprises choline chloride, betaine, or a combination thereof.

4. The composition of claim 1, wherein the mixture exhibits a viscosity index of at least 80 and a glass transition temperature of no higher than −90° C.

5. The composition of claim 1, wherein the first component has at most 5 carbon atoms per molecule.

6. The composition of claim 1, wherein the composition further comprises 0.1 to 5.0 wt % water, based on the total weight of the composition.

7. The composition of claim 1 wherein the composition exhibits a glass transition temperature of no higher than −110° C. and a kinematic viscosity at 100° C. in a range from 2.0 to 6.0 cSt.

8. The composition of claim 1, exhibiting a viscosity index of at least 140 and/or a kinematic viscosity at 100° C. of at least 3.5 cSt.

9. The composition of claim 1, wherein the composition exhibits a traction coefficient of no higher than 0.01 at temperatures in a range from 40° C. to 100° C. as determined using a mini traction machine at a speed of 2 m/s and a pressure of 0.75 GPa.

10. A lubricating oil comprising a primary lubricating oil base stock and a secondary lubricant component having a composition capable of forming a eutectic mixture, wherein the eutectic mixture comprises a first component comprising a quaternary amine having at most 6 carbon atoms per molecule and a second component comprising an ethylene glycol wherein:

the eutectic mixture comprises an equilibrium phase between the first component and the second component;

a molar ratio of the first component to the second component in the eutectic mixture ranges from 1:1 to 1:4; and the eutectic mixture exhibits a glass transition temperature of no higher than −70° C., a viscosity index of at least 120, and a kinematic viscosity at 100° C. in a range from 2.0 to 10 cSt.

11. The lubricating oil of claim 10, wherein the molar ratio of the first component to the second component in the eutectic mixture ranges from 1:2 to 1:4.

12. The lubricating oil of claim 10, further comprising one or more of an antiwear additive, a viscosity modifier, an antioxidant, a detergent, a dispersant, a pour point depressant, a corrosion inhibitor, a metal deactivator, a seal compatibility additive, an antifoaming agent, and an anti-rust additive.

13. The lubricating oil of claim 10, wherein, based on the total weight of the lubricating oil:

the primary lubricating oil base stock is present at a concentration in a range from 50 to 95 wt %; and/or the secondary lubricant component stock is present at a concentration in a range from 1.0 to 20 wt %.

14. A composition comprising a eutectic mixture of:

a first component comprising a quaternary amine having at most 6 carbon atoms per molecule; and a second component comprising an ethylene glycol;

wherein a molar ratio of the first component to the second component in the mixture is in a range from 1:2 to 1:4, and the composition exhibits a glass transition temperature of no higher than −70° C., a viscosity index of at least 140, and a kinematic viscosity at 100° C. in a range from 3.0 to 6 cSt.

15. A composition comprising a eutectic mixture of:

a first component comprising a quaternary amine having at most 6 carbon atoms per molecule; and a second component comprising an ethylene glycol;

wherein a molar ratio of the first component to the second component in the mixture is in a range from 1:1 to 1:4, and the composition exhibits a glass transition temperature of no higher than −70° C., a viscosity index of at least 120, and a kinematic viscosity at 100° C. in a range from 2.0 to 10 cSt wherein the mixture is formed in the absence of any additional solvent that dissolves both compounds.

16. The composition of claim 15 wherein the first and second components are compatible.

17. The lubricating oil of claim 10, wherein the eutectic mixture is used to deliver additives that have limited solubility in lubricants.

18. The lubricating oil of claim 17, wherein the delivery can be triggered by either heat, moisture, or other solvent.

* * * * *